US006680581B2

(12) United States Patent
Lee et al.

(10) Patent No.: US 6,680,581 B2
(45) Date of Patent: Jan. 20, 2004

(54) APPARATUS AND METHOD FOR DRIVING PLASMA DISPLAY PANEL

(75) Inventors: Jun-Young Lee, Cheonan (KR); Jung-Pil Park, Cheonan (KR); Byung-Nam An, Busan (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 10/270,668

(22) Filed: Oct. 16, 2002

(65) Prior Publication Data

US 2003/0071578 A1 Apr. 17, 2003

(30) Foreign Application Priority Data

Oct. 16, 2001 (KR) ..... 2001-63803
Feb. 18, 2002 (KR) ..... 2002-8405

(51) Int. Cl.[7] ..... G09G 3/28

(52) U.S. Cl. ..... 315/169.3; 315/169.4; 345/60; 345/68

(58) Field of Search ..... 315/169.3, 169.4, 315/169.1; 345/60, 68, 70, 69

(56) References Cited

U.S. PATENT DOCUMENTS 4,866,349 A * 9/1989 Weber et al. ..... 315/169.4
5,081,400 A * 1/1992 Weber et al. ..... 315/169.4
6,011,355 A * 1/2000 Nagai ..... 315/169.3
6,150,999 A * 11/2000 Chen et al. ..... 345/60
6,175,192 B1 * 1/2001 Moon ..... 315/169.3

* cited by examiner

*Primary Examiner*—James Clinger
*Assistant Examiner*—Ephrem Alemu
(74) *Attorney, Agent, or Firm*—McGuireWoods LLP

(57) ABSTRACT

An apparatus and method for driving a plasma display panel (PDP) where a switch device can perform zero voltage switching in driving the PDP. The apparatus for driving the PDP includes a sustain-discharge unit including first through fourth switches respectively connected to both ends of a panel capacitor between a power source and ground, for sustaining a panel capacitor terminal voltage to be at a first or a second sustain-discharge voltage; a first charge and discharge unit including a first inductor, for increasing the voltage of the panel capacitor to the first sustain-discharge voltage and switching a first switch in a state of a zero voltage by half of a resonance current generated by the first inductor; and a second charge and discharge unit including a second inductor, for decreasing the voltage of the panel capacitor to the second sustain-discharge voltage and switching a third switch in a state of the zero voltage by half of a resonance current generated by the second inductor.

23 Claims, 8 Drawing Sheets

APPARATUS AND METHOD FOR DRIVING PLASMA DISPLAY PANEL

BACKGROUND OF THE INVENTION

1. Field of the Invention

The present invention relates to an apparatus and a method for driving a plasma display panel (PDP). More specifically, the present invention relates to an apparatus and a method for driving a PDP, where a switch device can perform zero voltage switching in driving the PDP.

2. Description of the Related Art

In general, a PDP is a flat plate display for displaying characters or images using plasma generated by gas discharge. Pixels ranging from hundreds of thousands to more than millions are arranged in the form of a matrix according to the size of the PDP. PDPs are divided into direct current (DC) PDPs and alternating current (AC) PDPs according to the shape of the waveform of an applied driving voltage and the structure of a discharge cell.

The most significant difference between the DC PDP and the AC PDP lies in that current directly flows in discharge spaces while a voltage is applied in the DC PDP, because electrodes are exposed to the discharge spaces. Therefore, a resistor for restricting the current must be used outside of the DC PDP. On the other hand, in the case of the AC PDP, the current is restricted due to the natural formation of capacity because a dielectric layer covers the electrodes. The AC PDP has a longer life than the DC PDP because the electrodes are protected against the shock caused by ions during discharge. A memory characteristic that is one of the important characteristics of the AC PDP is caused by the capacity due to the dielectric layer that covers the electrodes.

According to the light emission principle of the AC PDP, discharge occurs because an electric potential difference in the form of a pulse is formed in common electrodes (X electrodes) and scan electrodes (Y electrodes). As such, vacuum ultraviolet (UV) rays generated in a discharge process are excited to red R, green G, and blue B fluorescent bodies. The respective fluorescent bodies emit light due to light combination.

In the AC PDP, because the X electrodes and the Y electrodes for sustaining discharge operate as capacitive loads, capacitance $C_p$ with respect to the X and Y electrodes exists. Reactive power other than power for discharge is necessary in order to apply waveforms for the sustain-discharge. A circuit for recovering and re-using the reactive power is referred to as a sustain-discharge circuit, or a power recovery circuit.

According to the method for driving the panel by the X and Y electrode driving circuits, a frame consists of n sub-fields. A sub-field consists of a reset period, a scan period, a sustain period, and an erase period.

In the reset period, the address electrodes $A_1$ through $A_m$ and the X electrodes are sustained to be at 0 V in the first half thereof. A voltage of more than a discharge starting voltage to a voltage of no more than the discharge starting voltage with respect to the sustain electrodes is applied to the Y electrodes. In the latter half of the reset period, the voltage of no more than the discharge starting voltage with respect to the sustain electrodes is applied to the scan electrodes. In the scan period, the scan electrodes are sustained to be at a scan voltage. A positive scan pulse voltage and a scan pulse voltage (0 V) are simultaneously applied to the address electrode corresponding to the discharge cell to be displayed in the first line among addressing electrodes and the scan electrode in the first line, respectively, so that the wall charge is accumulated. In the sustain period, a predetermined sustain pulse is applied to the scan and sustain electrodes so that the sustain-discharge occurs in gray scales to be displayed in the discharge cells. In the erase period, a predetermined erase pulse is applied to the sustain electrodes so that the sustain-discharge is stopped.

Driving of the sustain-discharge circuit of a conventional AC PDP will now be described with reference to FIGS. 1A and 1B that show a conventional sustain-discharge circuit and the operation waveforms of the conventional sustain-discharge circuit.

As shown in FIG. 1A, the sustain-discharge circuit suggested by L. F. Weber and disclosed in the U.S. Pat. Nos. 4,866,349 and 5,081,400, is the sustain-discharge circuit or the power recovery circuit of the AC PDP. In the driving circuit of the AC PDP, a sustain-discharge circuit 10 of the X electrodes has the same structure as that of a sustain-discharge circuit 11 (not shown in detail) of the Y electrodes. The sustain-discharge circuit of the X electrodes will now be described for sake of convenience.

The conventional sustain-discharge circuit 10 includes a power recovery unit comprising two switches $S_1$ and $S_2$, two diodes $D_1$ and $D_2$, and a power recovery capacitor $C_c$ and a sustain-discharge unit comprising two serially connected switches $S_3$ and $S_4$. An inductor $L_c$ is connected between the diodes $D_1$ and $D_2$ of the power recovery unit and the two switches $S_3$ and $S_4$ of the sustain-discharge unit. A load having a capacitor $C_p$ of the PDP is connected to the sustain-discharge unit. At this juncture, a parasitic device is not displayed.

The conventional sustain-discharge circuit having the above structure operates in four modes according to the switching sequence operations of the switches $S_1$ through $S_4$, as shown in FIG. 1B. The waveforms of the current $I_L$ that flows through an output voltage $V_p$ and the inductor $L_c$ are respectively shown according to the switching sequence operations.

In an initial stage, the panel both-end voltage is sustained to be 0 V because the switch $S_4$ is made to turn on just before the switch $S_1$ is made to turn on. As such, the power recovery capacitor $C_c$ is previously charged by a voltage $V_s/2$ that is half of an external applied voltage $V_s$ so that a rush current is not generated when the sustain-discharge starts.

In a state where the panel both-end voltage $V_p$ is sustained to be 0 V, at the point of time $t_0$, the operation of a mode 1 where the switch $S_1$ is turned on and the switches $S_2$, $S_3$, and $S_4$ are turned off, starts.

In the operation periods between $t_0$ and $t_1$ of the mode 1, an LC resonance circuit is formed through the channel of the power recovery capacitor $C_c$, the switch $S_1$, the diode $D_1$, the inductor $L_c$, and the plasma panel capacitor $C_p$. Therefore, the current $I_L$ flows through the inductor $L_c$ and the output voltage $V_p$ of the panel increases.

As shown in FIG. 1B, the current $I_L$ that flows through the inductor $L_C$ slowly decreases due to parasitic resistance (not shown) and becomes 0 at the point of time $t_1$. The output voltage $V_p$ of the panel becomes the external applied voltage $V_s$.

When the mode 1 is completed, a mode 2, where the switches $S_1$ and $S_3$ are turned on and the switches $S_2$ and $S_4$ are turned off, starts. In the operation period between $t_1$ and $t_2$ of the mode 2, the external applied voltage $V_s$ directly flows through the panel capacitor $C_p$ through the switch $S_3$, to thus sustain the output voltage $V_p$ of the panel.

When the mode 2 is completed in a state where the discharge of the output voltage $V_p$ of the panel is sustained, a mode 3, where the switch $S_2$ is turned on and the switches $S_1$, $S_3$, and $S_4$ are turned off, starts.

In the operation period between $t_2$ and $t_3$ of the mode 3, the LC resonance circuit is formed through the channel reverse to that in the mode 1, that is, through the channel of the plasma panel capacitor $C_p$, the inductor $L_c$, the diode $D_1$, the switch $S_2$, and the power recovery capacitor $C_c$. Accordingly, as shown in FIG. 1B, the current $I_L$ flows through the inductor $L_c$ and the output voltage $V_p$ of the panel decreases. Therefore, the current $I_L$ of the inductor $L_c$ and the output voltage $V_p$ of the panel become 0 at the point of time $t_3$.

In the operation period between $t_3$ and $t_4$ of a mode 4, the switches $S_2$ and $S_4$ are turned on and the switches $S_1$ and $S_3$ are turned off. Accordingly, the output voltage $V_p$ of the panel is sustained to be 0 V. When the switch $S_1$ is turned on again in this state, the process returns to the operation of the mode 1. Accordingly, the operations are repeated thereinafter.

In the conventional sustain-discharge circuit 10, because the number of the switches of the power recovery unit of the entire sustain-discharge circuit (including the X and Y electrode driving circuits) is four, the structure of an operation driver is complicated. Because a high-priced switch device is used, it is difficult to realize a low-priced sustain-discharge driving circuit.

In addition, it is not possible for the switches that form the circuit to perform the zero voltage switching due to the parasitic components of the driving circuit such as the parasitic resistance of the inductor, the parasitic resistances of the capacitor and the panel, and the conductance resistance of the switch. Accordingly, switching loss significantly increases when the switches are turned on.

Also, a significantly large rush current is generated when a sustain pulse starts in a state where the power recovery capacitor $C_c$ is not charged to the voltage $V_s/2$ right after the light emission starts.

SUMMARY OF THE INVENTION

It is an object of the present invention to provide a sustain-discharge circuit of a PDP, wherein a sustain-discharge circuit can be operated by a switch, an operation switch that forms the sustain-discharge circuit can perform zero voltage switching, and a rush current can be prevented without an additional external protecting circuit just after light emission starts.

In order to achieve the above object, in an embodiment of the present invention, there is provided an apparatus and a method for driving a PDP including a plurality of address electrodes, a plurality of scan electrodes and sustain electrodes arranged in a zig-zag pattern so as to make pairs with each other, and a panel capacitor formed by the scan electrodes and the sustain electrodes.

In one aspect of an embodiment of the present invention, there is provided an apparatus for driving a PDP including a sustain-discharge unit and first and second charge and discharge units. The sustain-discharge unit includes first and second switches, which are serially connected to each other between a power source to which a sustain-discharge voltage is applied and a ground, and whose contact point is connected to one end of the panel capacitor; and third and fourth switches, which are serially connected to each other between the power source and the ground and whose contact point is connected to the other end of the panel capacitor. The first charge and discharge unit includes a first inductor whose one end is coupled to one end of the panel capacitor, and which increases the voltage of the panel capacitor to the first sustain-discharge voltage using a resonance of the first inductor and the panel capacitor. The second charge and discharge unit includes a second inductor whose one end is coupled to the other end of the panel capacitor, and which decreases the voltage of the panel capacitor to the second sustain-discharge voltage using a resonance of the second inductor and the panel capacitor.

At this time, the sustain-discharge unit drives the first switch during resonance of the first inductor, to thus sustain the first sustain-discharge voltage, and drives the third switch during resonance of the second inductor, to thus sustain the second sustain-discharge voltage.

In a second aspect of an embodiment of the present invention, there is provided an apparatus for driving a PDP including first through sixth switches, first and second inductors, and first and second diodes. The first and second switches are serially connected to each other between a power source to which a sustain-discharge voltage is applied and a ground and a contact point thereof is connected to one end of the panel capacitor. The third and fourth switches are serially connected to each other between the power source and the ground, and a contact point thereof is connected to the other end of the panel capacitor. The first inductor has one end coupled to one end of the panel capacitor, and the second inductor has one end coupled to the other end of the panel capacitor. The fifth and sixth switches are respectively connected between the power source and the other end of the first inductor, and between the power source and the other end of the second inductor. The first and second diodes are respectively connected between the other end of the first inductor and the ground, and between the other end of the second inductor and the ground.

In a third aspect of an embodiment of the present invention, there is provided an apparatus for driving a PDP including first through eighth switches, first and second inductors, and first through fourth diodes. The first and second switches are serially connected to each other between a power source to which a sustain-discharge voltage is applied and a ground, and a contact point thereof is connected to one end of the panel capacitor. The third and fourth switches are serially connected to each other between the power source and the ground, and a contact point thereof is connected to the other end of the panel capacitor. The first inductor has one end coupled to one end of the panel capacitor, and the second inductor has one end coupled to the other end of the panel capacitor. The fifth and sixth switches are serially connected to each other between the power source and the ground, and a contact point thereof is connected to the other end of the first inductor. The seventh and eighth switches are serially coupled to each other between the power source and the ground, and a contact point thereof is connected to the other end of the second inductor. The first and second diodes are serially connected to each other between the power source and the ground in a backward direction, and a contact point thereof is connected to the other end of the first inductor. The third and fourth diodes are serially connected to each other between the power source and the ground in a backward direction, and a contact point thereof is connected to the other end of the second inductor.

In fourth through seventh aspects of an embodiment of the present invention, there is provided a method for driving a PDP including a plurality of address electrodes, a plurality of scan electrodes and sustain electrodes arranged in a zig-zag pattern so as to make pairs with each other, a panel capacitor formed by the scan electrodes and the sustain electrodes, first and second switches, which are serially connected to each other between a power source for supplying a sustain-discharge voltage and a ground, and whose contact point is connected to one end of the panel capacitor, third and fourth switches, which are serially connected to each other between the power source and the ground and whose contact point is connected to the other end of the panel capacitor, and first and second inductors connected to one end and to the other end of the panel capacitor.

In a fourth aspect of an embodiment of the present invention, according to a method for driving a PDP, the voltage of the panel capacitor increases to a first sustain-discharge voltage using a resonance generated by the panel capacitor and the first inductor due to the driving of the fourth switch and a fifth switch connected between the power source and the first inductor. The first and fourth switches are driven during the resonance to thus sustain the voltage of the panel capacitor to be at the first sustain-discharge voltage. The voltage of the panel capacitor decreases to a second sustain-discharge voltage using resonance generated by the panel capacitor and the second inductor due to the driving of the second switch and a sixth switch connected between the power source and the second inductor. The second and third switches are driven during the resonance to thus sustain the voltage of the panel capacitor to be at the second sustain-discharge voltage.

In a fifth aspect of an embodiment of the present invention, according to a method for driving a PDP, the voltage of the panel capacitor increases to a first sustain-discharge voltage using a resonance generated by the panel capacitor and the first and second inductors due to the driving of a fifth switch connected between the power source and the first inductor, and a sixth switch connected between the second inductor and the ground. The fifth and sixth switches are turned off during the resonance and driving of the first and fourth switches to thus sustain the voltage of the panel capacitor to be at the first sustain-discharge voltage. The voltage of the panel capacitor decreases to a second sustain-discharge voltage using a resonance generated by the panel capacitor and the first and second inductors due to the driving of a seventh switch connected between the power and the second inductor, and an eighth switch connected between the first inductor and the ground. The seventh and eighth switches are turned off during the resonance and driving of the second and third switches to thus sustain the voltage of the panel capacitor to be at the second sustain-discharge voltage.

In a sixth aspect of an embodiment of the present invention, according to a method for driving a PDP, first and fourth switches are driven to thus sustain the voltage of the panel capacitor to be at a first sustain-discharge voltage. Fifth and sixth switches, respectively connected between the ground and the first inductor and between the second inductor and the power source, are additionally driven to thus inject current into the first and second inductors in a state where the voltage of the panel capacitor is sustained to be at the first sustain-discharge voltage. The first, fourth, fifth, and sixth switches are turned off to thus decrease the voltage of the panel capacitor to a second sustain-discharge voltage using resonance generated by the first and second inductors and the panel capacitor. The second and third switches are driven to thus sustain the voltage of the panel capacitor to be at the second sustain-discharge voltage. Seventh and eighth switches, respectively connected between the power source and the first inductor and between the second inductor and the ground, are additionally driven to thus inject current into the first and second inductors in a state where the voltage of the panel capacitor is sustained to be at the second sustain-discharge voltage. The second, third, seventh, and eighth switches are turned off to thus increase the voltage of the panel capacitor to a first sustain-discharge voltage using resonance generated by the first and second inductors and the panel capacitor.

In a seventh aspect of an embodiment of the present invention, according to a method for driving a PDP, fifth and sixth switches, respectively connected between the power source and the first inductor and between the second inductor and the ground are driven to thus inject current into the first and second inductors in a state where the voltage of the panel capacitor is sustained to be at a first sustain-discharge voltage by the driven second and third switches. The second and third switches are turned off to thus increase the voltage of the panel capacitor to a second sustain-discharge voltage using resonance generated by the first and second inductors and the panel capacitor. The fifth and sixth switches are turned off and the first and fourth switches are driven to thus sustain the voltage of the panel capacitor to be at the second sustain-discharge voltage. Seventh and eighth switches, respectively connected between the first inductor and the ground and between the power source and the second inductor, are additionally driven to thus inject current into the first and second inductors in a state where the voltage of the panel capacitor is sustained to be at the second sustain-discharge voltage. The first and fourth switches are turned off, to thus decrease the panel capacitor to the first sustain-discharge voltage using resonance generated by the first and second inductors and the panel capacitor. The seventh and eighth switches are turned off and the second and third switches are driven to thus sustain the voltage of the panel capacitor to be at the first sustain-discharge voltage.

BRIEF DESCRIPTION OF THE DRAWINGS

The accompanying drawings, which are incorporated in and constitute a part of the specification, illustrate an embodiment of the invention, and, together with the description, serve to explain the principles of the invention, in which.

DETAILED DESCRIPTION OF THE PREFERRED EMBODIMENTS

In the following detailed description, only a preferred embodiment of the invention has been shown and described, simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

A sustain-discharge circuit according to a first embodiment of the present invention will now be described in detail with reference to FIGS. 2 and 3.

Figure 1A:
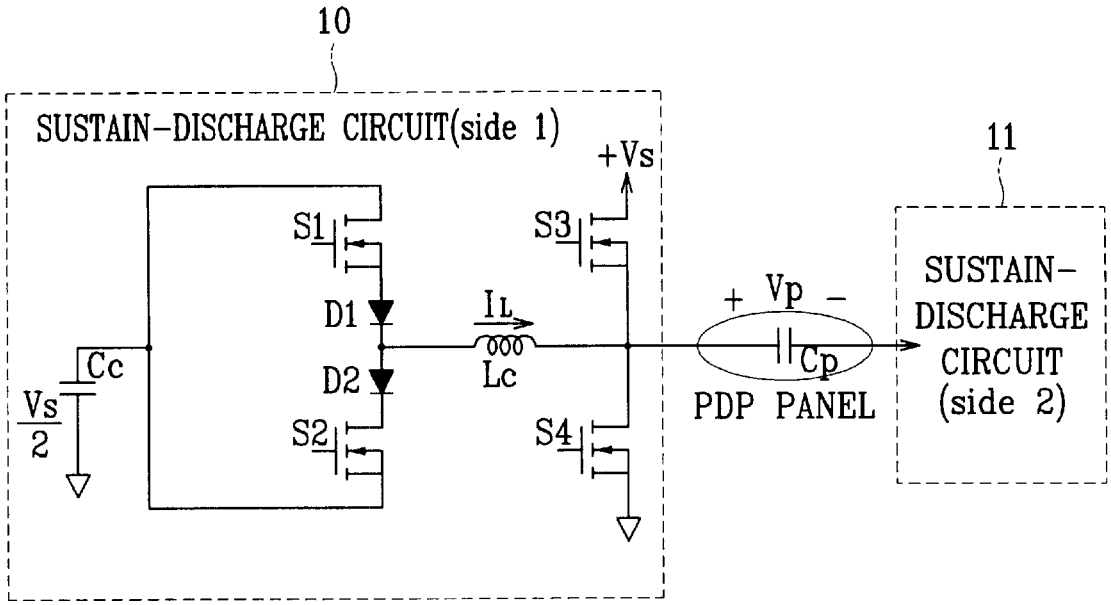
FIGS. 1A and 1B show a conventional sustain-discharge circuit and the operation waveforms of the conventional sustain-discharge circuit.
Figure 1B:
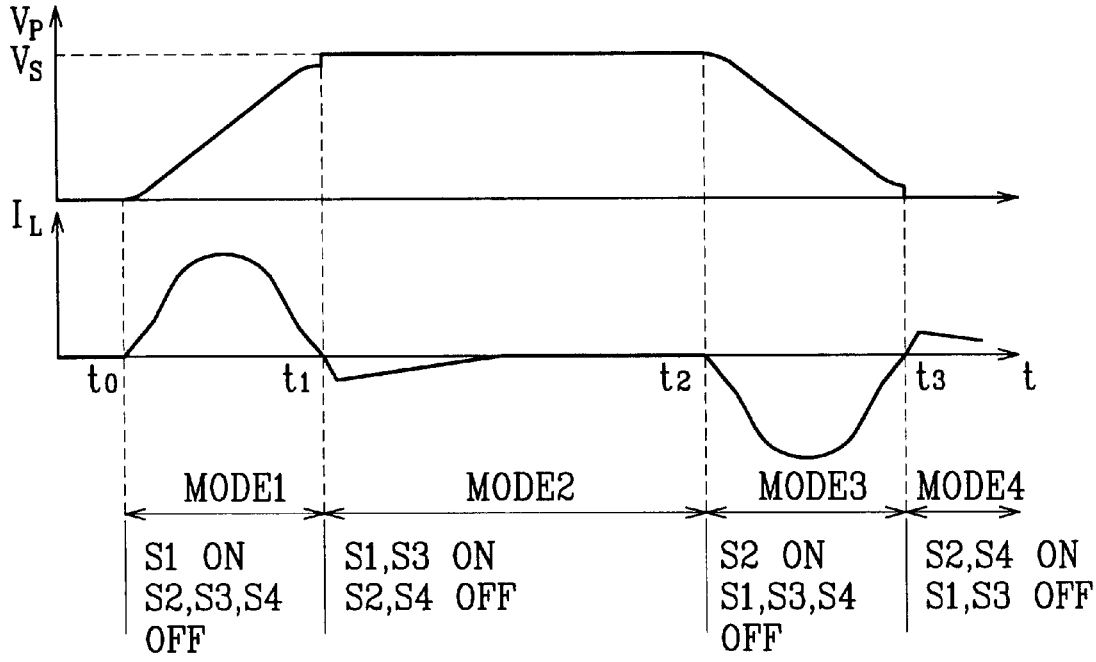
Figure 2:
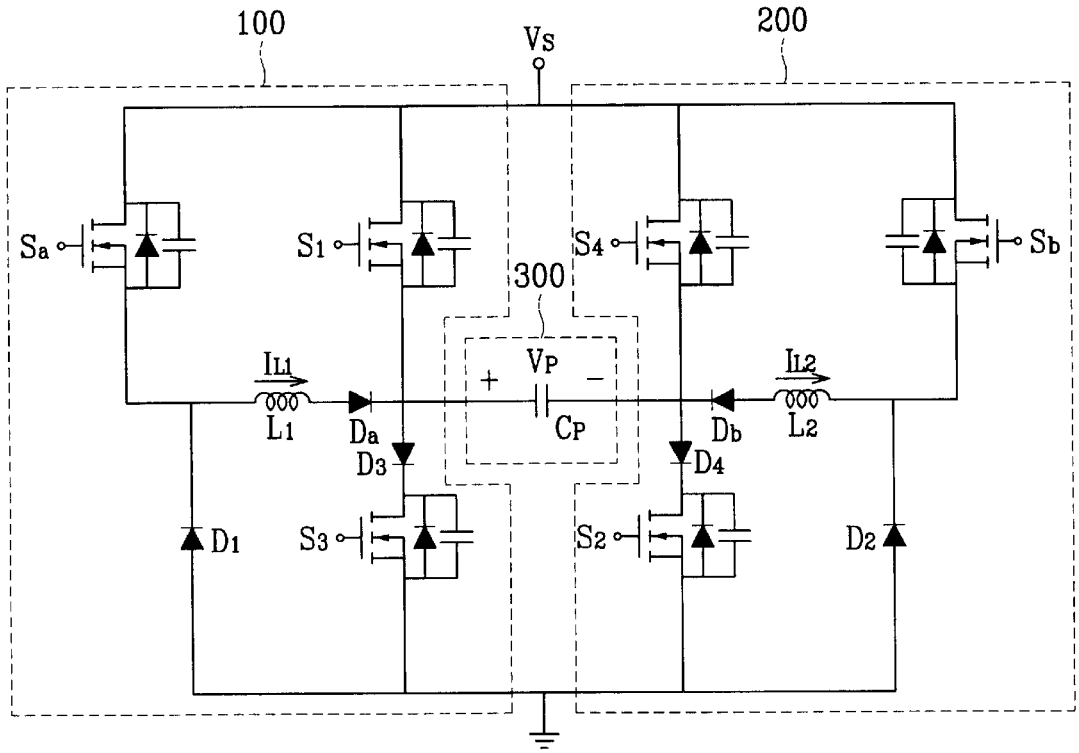
FIG. 2 is a circuit diagram showing a sustain-discharge circuit according to a first embodiment of the present invention.

FIG. 2 is a circuit diagram showing a sustain-discharge circuit according to a first embodiment of the present invention. FIG. 3 shows the operation waveforms of the sustain-discharge circuit according to the first embodiment of the present invention.

As shown in FIG. 2, the sustain-discharge circuit according to the first embodiment of the present invention includes a Y electrode driving unit 100 for sustain-discharging the Y electrode by the control pulse operation of a switch $S_a$, an X electrode driving unit 200 for sustain-discharging the X electrode by the control pulse operation of a switch $S_b$, and a panel 300 for displaying desired gray scales by sustain-discharging the wall charge accumulated in the respective X and Y electrodes according to the driving signal of the X and Y electrode driving units 200 and 100, respectively.

The Y electrode driving unit 100 includes three switches $S_a$, $S_1$, and $S_3$, three diodes $D_a$, $D_1$, and $D_3$, and an inductor $L_1$. Each switch is a MOSFET, and each further includes a body diode and an internal capacitor according to the characteristics of the MOSFET.

The X electrode driver 200 is symmetrical to the Y electrode driving unit 100 on the basis of the panel 300, and includes three switches $S_b$, $S_2$, and $S_4$, three diodes $D_b$, $D_2$, and $D_4$, and an inductor $L_2$.

Figure 3:
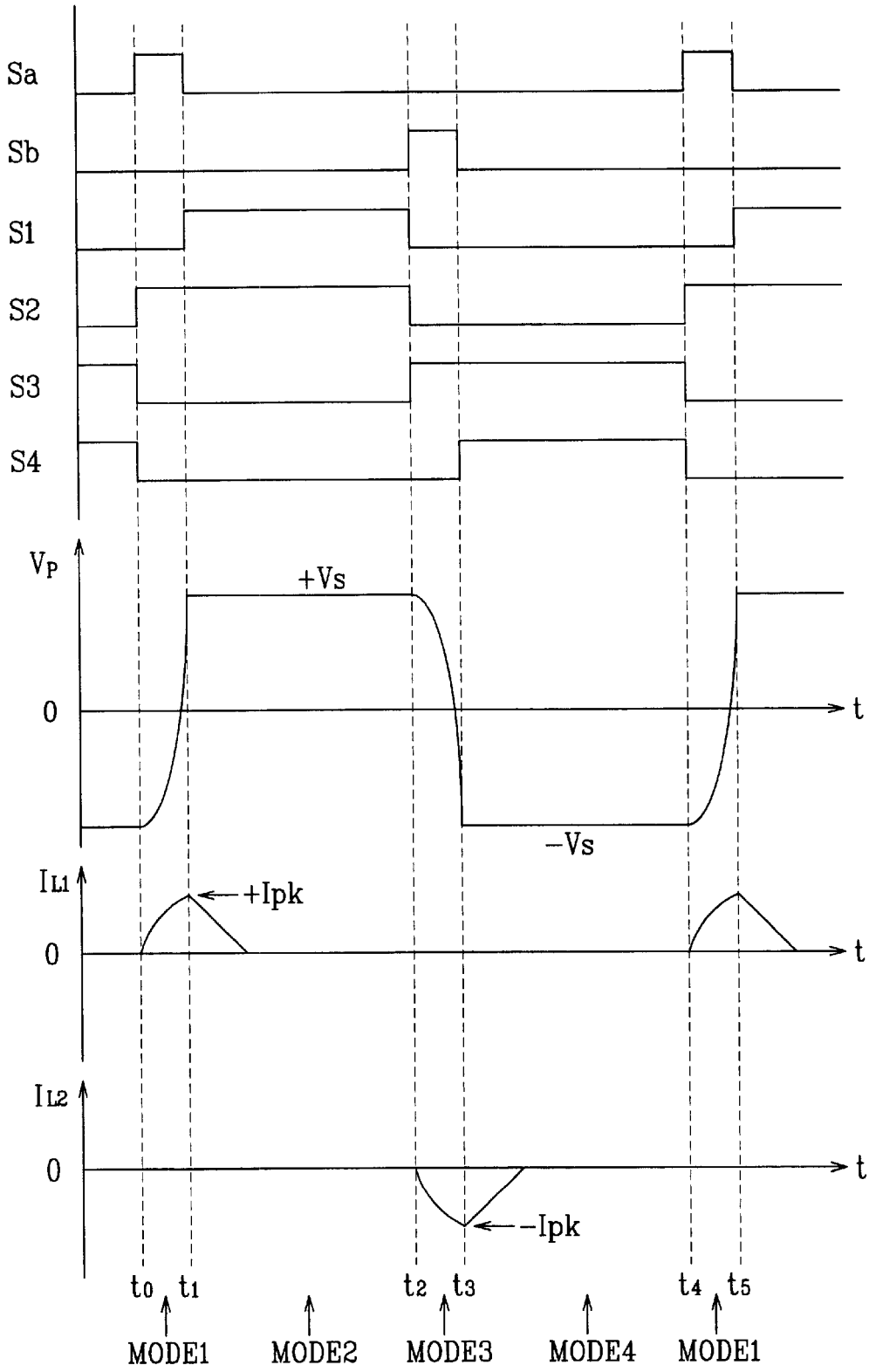
FIG. 3 shows the operation waveforms of the sustain-discharge circuit according to the first embodiment of the present invention.

As shown in FIG. 3, the operations of the sustain-discharge circuit according to the first embodiment of the present invention are divided into a mode 1 period $t_0$ through $t_1$ for charging the capacitor $C_p$ of the panel 300, a mode 2 period $t_1$ through $t_2$ for sustaining the capacitor $C_p$ to be at a high level voltage $+V_s$ for sustain-discharge, a mode 3 period $t_2$ through $t_3$ for discharging the capacitor $C_p$ of the panel, and a mode 4 period $t_3$ through $t_4$ for sustaining the capacitor $C_p$ to be at a low level voltage $-V_s$ for sustain-discharge. In order to describe an initial state, it is assumed that the current $I_L$ of the inductor is 0 in the initial mode 1 (section $t_0$ through $t_1$,) and that a panel both-end voltage is the voltage $-V_s$.

When the switch $S_a$ and the switch $S_2$ are turned on in the mode 1 period, a resonance circuit is formed through a path of the switch $S_a$—the inductor $L_1$—the diode $D_a$—the panel capacitor $C_p$—the diode $D_4$—the switch $S_2$. Current $I_{L1}$ that flows through the inductor $L_1$ from an external applied voltage $V_s$ is resonance current caused by the inductor $L_1$ and the panel capacitor $C_p$. The panel both-end voltage $V_p$ increases to the voltage $+V_s$ by the resonance current. The panel both-end voltage $V_p$ becomes the voltage $+V_s$ and the inductor current $I_{L1}$ increases to current $I_{pk}$ at a time $t_1$.

In the mode 2 period $t_1$ through $t_2$, when the switch $S_1$ is turned on at the time $t_1$, the panel both-end voltage $V_p$ is sustained to be at the external applied voltage $+V_s$ and the body diode of the switch $S_1$ and the diode $D_1$ conduct. The inductor current $I_{L1}$ increased to the current $I_{pk}$ during the mode 1 period flows toward power $V_s$ through the current path of the diode $D_1$—the inductor $L_1$—the diode $D_a$—the body diode of the switch $S_1$ since the switch $S_a$ is turned off. Accordingly, energy is recovered toward the power $V_s$.

Accordingly, the inductor current $I_{L1}$ linearly decreases to 0. The mode 2 period is completed when the switch $S_1$ and the switch $S_2$ are turned off at a time $t_2$. At the point of time where the switch $S_1$ is turned on, because the switch $S_1$ is turned on in a state where the drain-source both-end voltage $V_{ds}$ of the switch $S_1$ is a zero voltage, turn-on switching loss is not generated.

In the mode 3 period $t_2$ through $t_3$, when the switches $S_b$ and $S_3$ are turned on at a time $t_2$, a resonance circuit is formed through a path of the switch $S_b$—the inductor $L_2$—the diode $D_b$—the panel capacitor $C_p$—the diode $D_3$—the switch $S_3$. Resonance current $I_{L2}$ caused by the inductor $L_2$ and the panel capacitor $C_p$ flows through the inductor $L_2$. The panel both-end voltage decreases to the voltage $-V_s$ due to the resonance current. The panel both-end voltage $V_p$ becomes the voltage $-V_s$ and inductor current $I_{L2}$ decreases to current $-I_{pk}$ at a time $t_3$. When the switch $S_b$ is turned off at the time $t_3$, the mode 3 period is completed.

In a mode 4 period $t_3$ through $t_4$, when the switch $S_4$ is turned on at the time $t_3$, the voltage $V_p$ is sustained to be at the voltage $-V_s$ and the body diode of the switch $S_4$ and the diode $D_2$ conduct. The inductor current $I_{L2}$ that decreases to the current $-I_{pk}$ during the mode 3 period flows toward the power $V_s$ through the current path of the diode $D_2$—the inductor $L_2$—the diode $D_b$—the body diode of the switch $S_4$ since the switch $S_b$ is turned off. Energy is recovered toward the power $V_s$.

The inductor current $I_{L2}$ decreases to the current $-I_{pk}$ and linearly increases to 0 when it is assumed that current flows from the left side to the right side. When the switch $S_3$ and the switch $S_4$ are turned off at a time $t_4$, the mode 4 period is completed and the process returns to the mode 1 period. Accordingly, operation cycles are repeated thereinafter. At the point of time where the switch $S_4$ is turned on, because voltage difference between both ends of the switch $S_4$ becomes 0, zero voltage switching can be performed.

According to the sustain-discharge circuit according to the first embodiment of the present invention, because the switches $S_1$ and $S_4$ perform the zero voltage switching, switching is performed without turn-on switching loss. However, the operation potential of the X and Y electrode driving units decreases to no more than ground level potential (GND) while energy is recovered.

For example, in a state where the panel both-end voltage $V_p$ is sustained to be at the voltage $+V_s$ (like in the mode 2), the drain of the switch $S_3$ is at a voltage $+V_s$ level and the drain of the switch $S_2$ is a ground level. When the switch $S_b$ and the switch $S_3$ are turned on in order to invert the polarity of the panel both-end voltage into the voltage $-V_s$ at the time $t_2$, the drain of the switch $S_3$ decreases from the voltage $+V_s$ to the ground level the moment the switch $S_3$ is turned on. However, the panel both-end voltage $V_p$ is sustained to be at the voltage $+V_s$. Accordingly, the drain of the switch $S_2$ decreases to the voltage $-V_s$.

In order to compensate for a problem in that the operation potential of the X and Y electrode driving units, 100 and 200, respectively, in the first embodiment of the present invention decreases to no more than the ground level, a sustain-discharge circuit according to a second embodiment of the present invention is provided.

Figure 4:
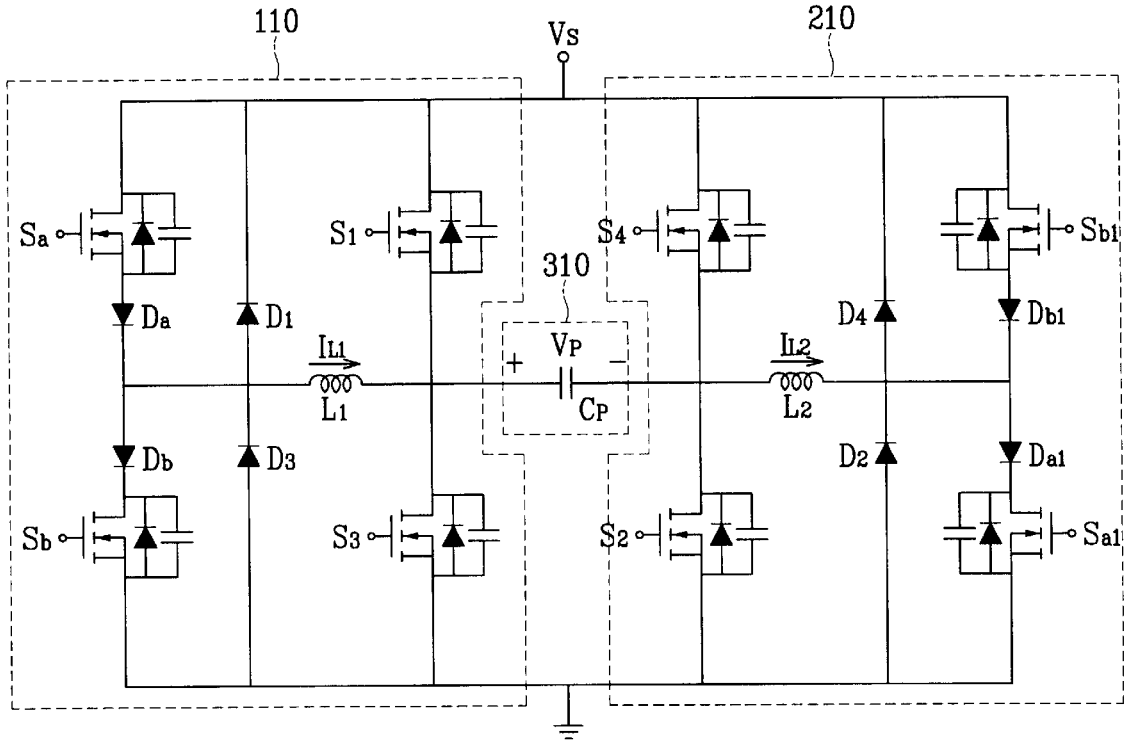
FIG. 4 is a circuit diagram showing a sustain-discharge circuit according to a second embodiment of the present invention.
Figure 5:
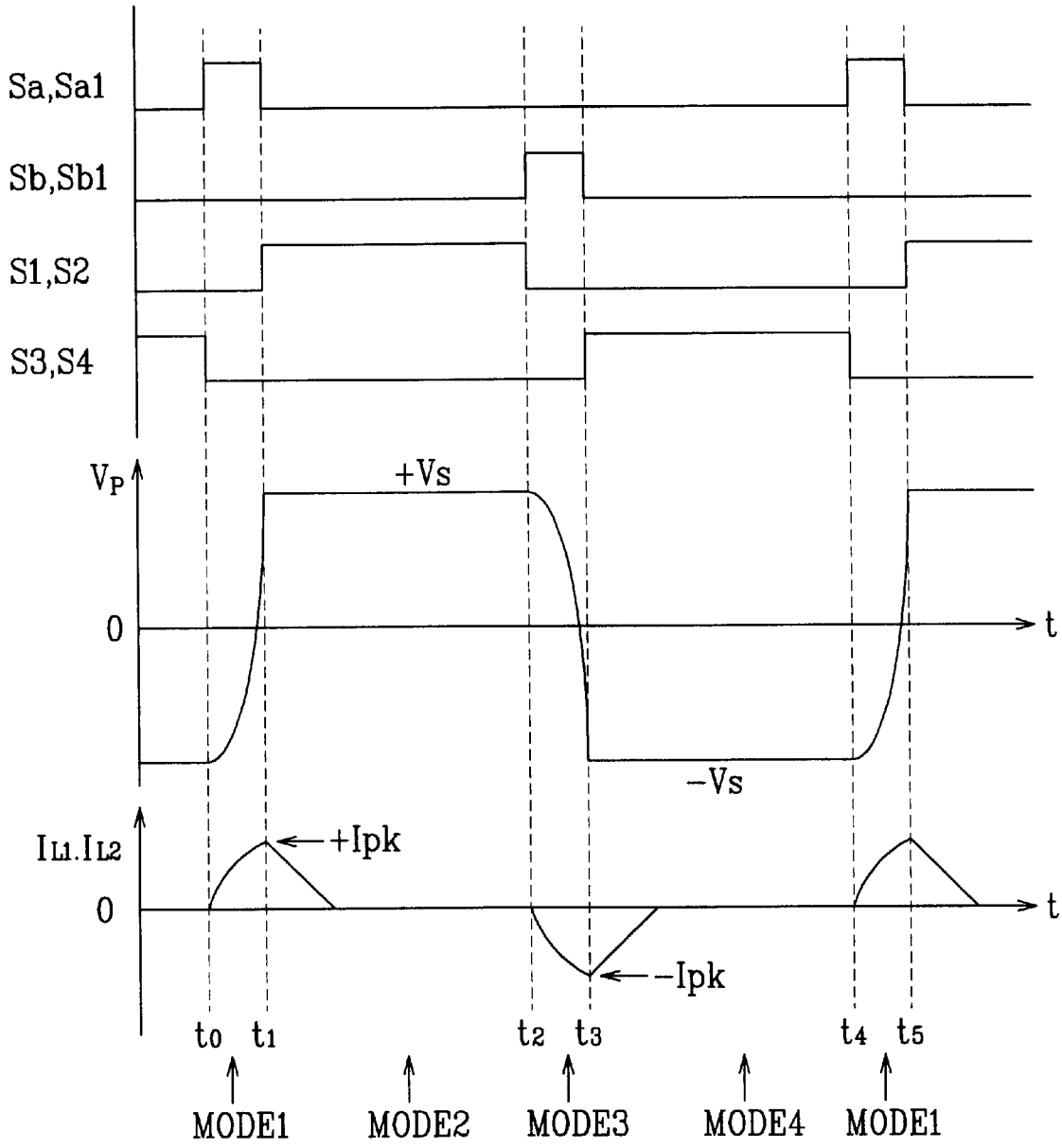
FIG. 5 shows the operation waveforms of the sustain-discharge circuit according to the second embodiment of the present invention.

FIG. 4 is a circuit diagram showing a sustain-discharge circuit according to a second embodiment of the present invention. FIG. 5 shows the operation waveforms of the sustain-discharge circuit according to the second embodiment of the present invention.

The sustain-discharge circuit according to the second embodiment of the present invention has the same structure as that of the sustain-discharge circuit according to the first embodiment of the present invention. Description of parts overlapping the first embodiment of the present invention will therefore be omitted.

As shown in FIG. 4, the sustain-discharge circuit according to the second embodiment of the present invention includes a Y electrode driving unit 110 for sustain-discharging the Y electrode by the control pulse operation of the switches $S_a$ and $S_b$ in the sustain-discharge circuit according to the first embodiment, an X electrode driving unit 210 for sustain-discharging the X electrode by the control pulse operation of switches $S_{a1}$ and $S_{b1}$, and the panel 300 for displaying desired gray scales by performing the sustain-discharge of the wall charge accumulated in the respective X and Y electrodes according to the driving signal of the X and Y electrode driving units 210 and 110.

The Y electrode driving unit 110 includes the four switches $S_a$, $S_b$, $S_1$, and $S_3$, the four diodes $D_a$, $D_b$, $D_1$, and $D_3$, and the inductor $L_1$. The X electrode driving unit 210 includes the four switches $S_{a1}$, $S_{b1}$, $S_2$, and $S_4$, the four switches $D_{a1}$, $D_{b1}$, $D_2$, and $D_4$, and the inductor $L_2$.

The operation of the sustain-discharge circuit according to the second embodiment of the present invention will now be described in detail with reference to FIG. 5.

When it is assumed that the inductor currents $I_{L1}$ and $I_{L2}$ are 0 and that the panel both-end voltage $V_p$ is the voltage $-V_s$, when the switch $S_a$ and the switch $S_{a1}$ are turned on in the mode 1 period, a resonance path of the switch $S_a$—the diode $D_a$—the inductor $L_1$—the panel capacitor $C_p$—the inductor $L_2$—the diode $D_{a1}$—the switch $S_{a1}$ is formed.

The inductor currents $I_{L1}$ and $I_{L2}$ become resonance current caused by serial connection between the inductor $L_1$ and the inductor $L_2$ flows. The panel both-end voltage increases to the voltage $+V_s$ according to the resonance current. At the time $t_1$, the panel both-end voltage $V_p$ becomes the voltage $+V_s$ and the inductor currents $I_{L1}$ and $I_{L2}$ increase to the current $I_{pk}$.

In the mode 2 (period $t_1$ through $t_2$), when the switch $S_1$ and the switch $S_2$ are turned on at the time $t_1$, the panel both-end voltage $V_p$ is sustained to be at the voltage $+V_s$, and the body diodes of the switch $S_1$ and the switch $S_2$ and the diodes $D_3$ and $D_4$ conduct. The inductor current $I_{L1}$ that increases to the current $I_{pk}$ during the mode 1 period flows toward the power through the body diode of the switch $S_1$ and the diode $D_3$, and linearly decreases to 0. When the switch $S_1$ is turned on, because the switch $S_1$ is turned on in a state where the drain-source both-end voltage $V_{ds}$ is the zero voltage, the turn-on switching loss is not generated.

The current $I_{L2}$ that flows through the inductor $L_2$ flows toward the power through the body diode of the switch $S_2$ and the diode $D_4$, and linearly decreases to 0. At the point of time where the switch $S_2$ is turned on, the switch $S_2$ is turned on in a state where the drain-source both-end voltage $V_{ds}$ of the switch $S_2$ is the zero voltage, like when the switch $S_1$ is turned on. When the switch $S_1$ and the switch $S_2$ are turned off at the time $t_2$, the mode 2 period is completed.

In the mode 3 period $t_2$ through $t_3$, when the switch $S_b$ and the switch $S_{b1}$ are turned on at the time $t_2$, a resonance path of the switch $S_{b1}$—the diode $D_{b1}$—the inductor $L_2$—the panel capacitor $C_p$—the inductor $L_1$—the diode $D_b$—the switch $S_b$ is formed. The inductor currents $I_{L1}$ and $I_{L2}$ become the resonance current caused by the inductors $L_1$ and $L_2$ and the panel capacitor $C_p$. The panel both-end voltage decreases to the voltage $-V_s$. At the time $t_3$, the panel both-end voltage $V_p$ becomes the voltage $-V_s$, and the inductor currents $I_{L1}$ and $I_{L2}$ decrease to the current $-I_{pk}$. When the switch $S_b$ and the switch $S_{b1}$ are turned off, the mode 3 period is completed.

In the mode 4 period $t_3$ through $t_4$, when the switch $S_3$ and the switch $S_4$ are turned on at the time $t_3$, the panel both-end voltage $V_p$ is sustained to be at the voltage $-V_s$, and the body diodes of the switch $S_3$ and the switch $S_4$ and the diodes $D_1$ and $D_2$ conduct. The current $I_{L1}$ of the inductor $L_1$, which decreases to the current $-I_{pk}$ during the mode 3 period flows toward the power through the body diode of the switch $S_3$ and the diode $D_1$, and linearly increases to 0. At the point of time where the switch $S_3$ is turned on, because the switch $S_3$ is turned on in a state where the drain-source both-end voltage $V_{ds}$ of the switch $S_3$ is the zero-voltage, the turn-on switching loss is not generated.

Also, the current $I_{L2}$ that flows through the inductor $L_2$ flows toward the power through the body diode of the switch $S_4$ and the diode $D_2$ and linearly increases to 0. At the point of time where the switch $S_4$ is turned on, the switch $S_4$ is turned on in a state where the drain-source both-end voltage $V_{ds}$ of the switch $S_4$ is the zero-voltage, like when the switch $S_3$ is turned on.

When the switch $S_3$ and the switch $S_4$ are turned off at the time $t_4$, the mode 4 period is completed and the mode 1 period starts.

As mentioned above, according to the second embodiment of the present invention, the panel both-end voltage $V_p$ is changed using resonance. However, current can be previously injected into the inductor before changing the panel both-end voltage in the sustain-discharge circuit according to the second embodiment. That is, when the panel both-end voltage is sustained to be at the voltages $+V_s$ and $-V_s$, it is possible to inject current into the inductor and to change the panel both-end voltage using the current and the resonance. Such an embodiment will now be described with reference to FIGS. 6 and 7.

Figure 6:
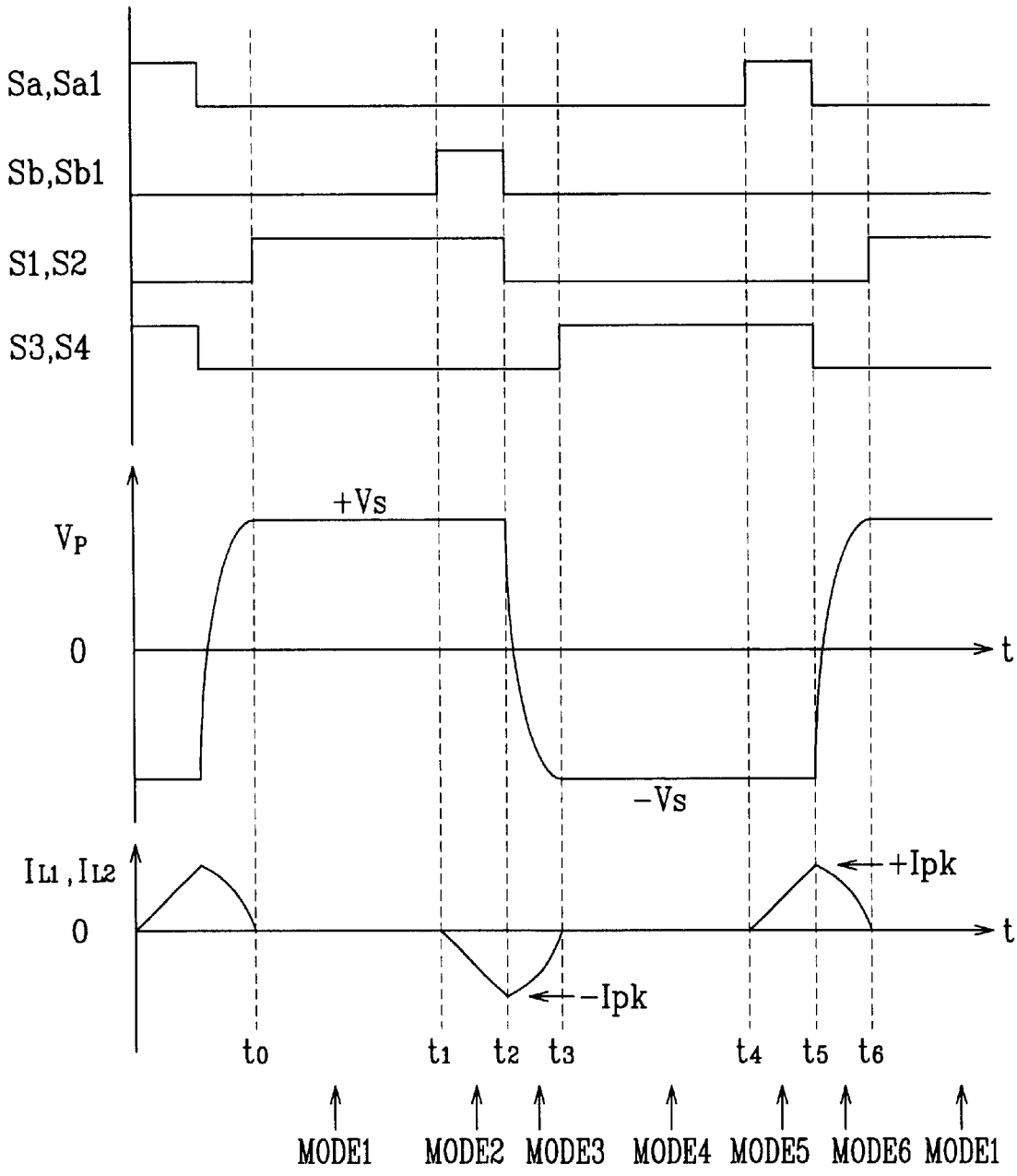
FIG. 6 shows the operation waveforms of a sustain-discharge circuit according to a third embodiment of the present invention.
Figure 7:
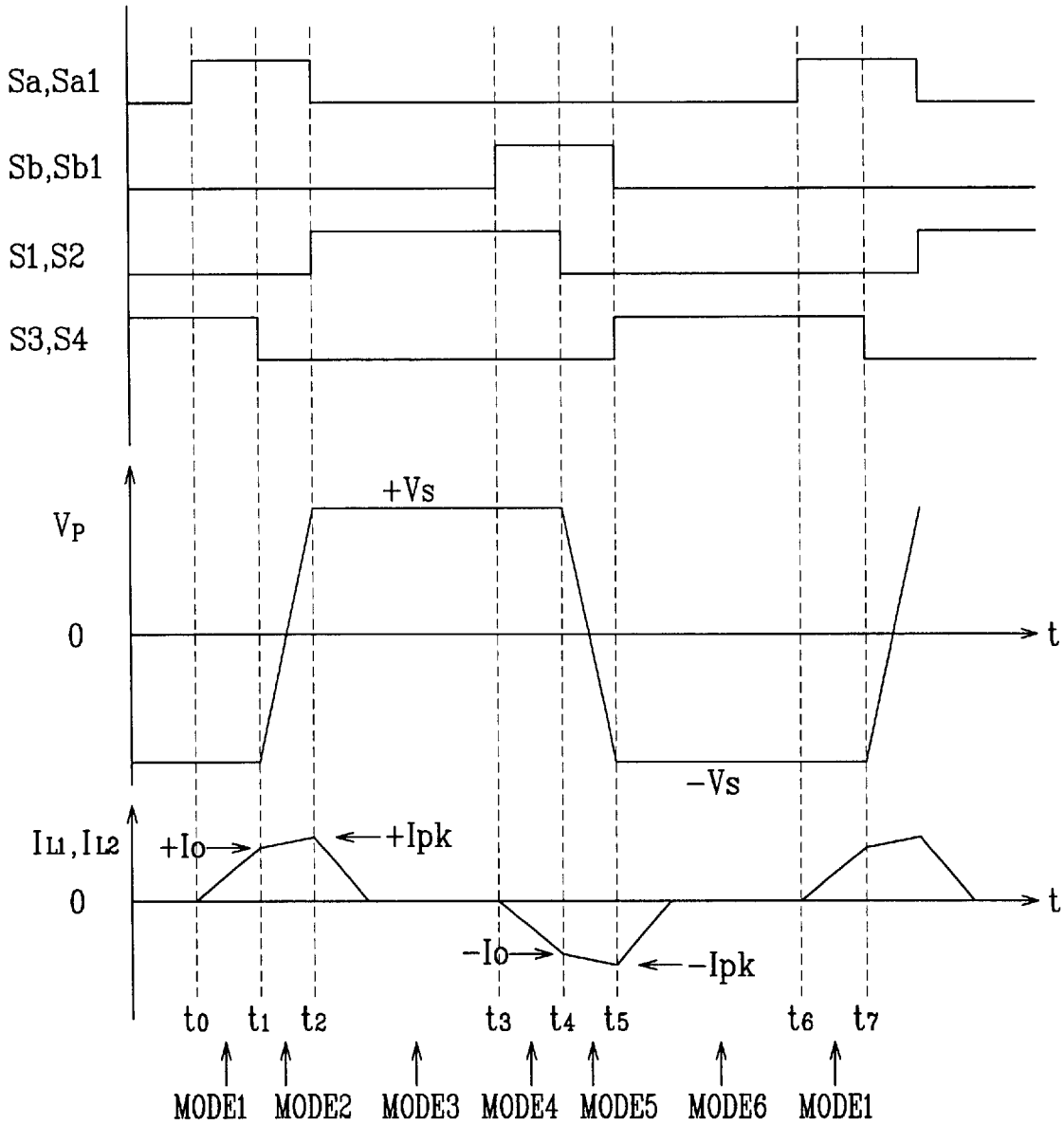
FIG. 7 shows the operation waveforms of a sustain-discharge circuit according to a fourth embodiment of the present invention.

FIGS. 6 and 7 respectively show the operation waveforms of the sustain-discharge circuits according to the third and fourth embodiments of the present invention.

The only difference between the third and fourth embodiments and the second embodiment is the operation waveforms of the sustain-discharge circuit.

The driving method according to the third embodiment will now be described with reference to FIG. 6. In the mode 1 period $t_0$ through $t_1$, the switches $S_1$ and $S_2$ are turned on. Accordingly, the panel both-end voltage $V_p$ is sustained to be at the voltage $+V_s$.

In the mode 2 period $t_1$ through $t_2$, the switches $S_b$ and $S_{b1}$ are turned on at the time $t_1$. A path of the switch $S_{b1}$—the diode $D_{b1}$—the inductor $L_2$—the switch $S_2$ is formed by the switches $S_2$ *and* $Sb1$ that are turned on. Accordingly, the current $I_{L2}$ that flows through the inductor $L_2$ linearly decreases to the current $-I_{pk}$. A path of the switch $S_1$—the inductor $L_1$—the diode $D_b$—the switch $S_b$ is formed by the switches $S_1$ and $S_b$ that are turned on. Accordingly, the current $I_{L1}$ that flows through the inductor linearly decreases to the current $-I_{pk}$.

In the mode 3 period $t_2$ through $t_3$, a resonance path of the diode $D_2$—the inductor $L_2$—the panel capacitor $C_p$—the inductor $L_1$—the diode $D_1$ is formed since the switches $S_1$, $S_2$, $S_b$, and $S_{b1}$ are turned off. Accordingly, resonance current caused by the inductor $L_1$+$L_2$ and the panel capacitor $C_p$ flows. The panel both-end voltage $V_p$ decreases to the voltage $-V_s$ due to the current. The inductor currents $I_{L1}$ and $I_{L2}$ increase to 0.

In the mode 4 period $t_3$ through $t_4$, the switches $S_3$ and $S_4$ are turned on at the time $t_3$. Accordingly, the panel both-end voltage $V_p$ is sustained to be at the voltage $-V_s$.

In the mode 5 period $t_4$ though $t_5$, the switches $S_a$ and $S_{a1}$ are turned on at the time $t_4$. A path of the switch $S_a$—the diode $D_a$—the inductor $L_1$—the switch $S_3$ is formed by the switches $S_3$ and $S_a$ that are turned on. Accordingly, the current $I_{L1}$ that flows through the inductor $L_1$ linearly increases to the current $+I_{pk}$. Also, a path of the switch $S_4$—the inductor $L_2$—the diode $D_{a1}$—the switch $S_{a1}$ is formed by the switches $S_4$ and $S_{a1}$ that are turned on. Accordingly, the current $I_{L2}$ that flows through the inductor $L_2$ linearly increases to the current $+I_{pk}$.

In the mode 6 period $t_5$ through $t_6$, a resonance path of the diode $D_3$—the inductor $L_1$—the panel capacitor $C_p$—the inductor $L_2$—the diode $D_4$ is formed since the switches $S_3$, $S_4$, $S_a$, and $S_{a1}$ are turned off. Accordingly, resonance current caused by the inductor $L_1+L_2$ and the panel capacitor $C_p$ flows. The panel both-end voltage $V_p$ increases to the voltage $+V_s$ and the inductor currents $I_{L1}$ and $I_{L2}$ decrease to 0 due to the current. When the switches $S_1$ and $S_2$ are turned on, the process returns to the mode 1 period and the cycles are repeated.

The driving method according to the fourth embodiment of the present invention having different driving waveforms will now be described with reference to FIG. 7.

As shown in FIG. 7, it is assumed that the switches $S_3$ and $S_4$ are turned on in a previous mode and that the panel both-end voltage $V_p$ is the voltage $-V_s$. In the mode 1 period $t_0$ through $t_1$, when the switches $S_a$ and $S_{a1}$ are turned on, a path of the switch $S_a$—the diode $D_a$—the inductor $L_1$—the switch $S_3$ and the path of the switch $S_4$—the inductor $L_2$—the diode $D_{a1}$—the switch $S_{a1}$ are respectively formed. Accordingly, the inductor currents $I_{L1}$ and $I_{L2}$ linearly increase to current $+I_o$.

In the mode 2 period $t_1$ through $t_2$, the switches $S_3$ and $S_4$ are turned off while the inductor currents $I_{L1}$ and $I_{L2}$ increase. A resonance path of the switch $S_a$—the diode $D_a$—the inductor $L_1$—the panel capacitor $C_p$—the inductor $L_2$—the diode $D_{a1}$—the switch $S_{a1}$ is formed. Accordingly, the panel both-end voltage $V_p$ increases from the voltage $-V_s$ to the voltage $+V_s$. The inductor currents $I_{L1}$ and $I_{L2}$ increase from the current $+I_o$ of the mode 1 to the current $+I_{pk}$, due to the current caused by the resonance.

In the mode 3 period $t_2$ through $t_3$, when the panel both-end voltage $V_p$ increases to the voltage $+V_s$, the switches $S_1$ and $S_2$ are turned on. Accordingly, the panel both-end voltage $V_p$ is sustained to be at the voltage $+V_s$. The inductor currents $I_{L1}$ and $I_{L2}$ are recovered to the power through a path of the diode $D_3$—the inductor $L_1$—the body diode of the switch $S_1$ and a path of the body diode of the switch $S_2$—the inductor $L_2$—the diode $D_4$, and linearly decrease to 0. When the switches $S_1$ and $S_2$ are turned on, because the switches $S_1$ and $S_2$ are turned on in a state where the drain-source both-end voltage $V_{ds}$ of each switch is the zero-voltage, it is possible to reduce the turn-on switching loss.

In the mode 4 period $t_3$ through $t_4$, the switches $S_b$ and $S_{b1}$ are turned on. Accordingly, the inductor currents $I_{L1}$ and $I_{L2}$ linearly decrease to current $-I_o$ through a path of the switch $S_1$—the inductor $L_1$—the diode $D_b$—the switch $S_b$ and a path of the switch $S_{b1}$—the diode $D_{b1}$—the inductor $L_2$—the switch $S_2$.

In the mode 5 period $t_4$ through $t_5$, the switches $S_1$ and $S_2$ are turned off while the inductor currents $I_{L1}$ and $I_{L2}$ decrease. A resonance path of the switch $S_{b1}$—the diode $D_{b1}$—the inductor $L_2$—the panel capacitor $C_p$—the inductor $L_1$—the diode $D_b$—the switch $S_b$ is formed. Accordingly, the inductor currents $I_{L1}$ and $I_{L2}$ decrease from the current $-I_o$ to the current $-I_{pk}$. The panel both-end voltage $V_p$ decreases from the voltage $+V_p$ to the voltage $-V_p$ due to the current.

In the mode 6 period $t_5$ through $t_6$, when the panel both-end voltage $V_p$ decreases to the voltage $-V_s$, the switches $S_3$ and $S_4$ are turned on. Accordingly, the panel both-end voltage $V_p$ is sustained to be at the voltage $-V_s$. The inductor currents $I_{L1}$ and $I_{L2}$ are recovered to the power through a path of the body diode of the switch $S_3$—the inductor $L_1$—the diode $D_1$ and a path of the diode $D_2$—the inductor $L_2$—the body diode of the switch $S_4$, and linearly increase to 0. Because the switches $S_3$ and $S_4$ are turned on in a state where the drain-source both-end voltage $V_{ds}$ of each switch is the zero voltage, it is possible to reduce the turn-on switching loss. When the switches $S_a$ and $S_1$ are turned on, the process returns to the mode 1 and the cycles are repeated.

As described in the third and fourth embodiments of the present invention, it is possible to increase the slope of a sustain-discharge voltage waveform without changing the current stress of a supplementary switch by previously boosting the current of the inductor. Accordingly, it is possible to prevent the panel from being discharged without special reasons when the sustain-discharge voltage increases and decreases.

While this invention has been particularly shown and described with reference to preferred embodiments thereof, it will be understood by those skilled in the art that various changes in form and details may be made therein without departing from the spirit and scope of the invention as defined by the appended claims.

As mentioned above, in the apparatus and method for driving the PDP according to embodiments of the present invention, because the sustain-discharge circuit can be operated by a switch, it is possible to simplify the structure of the driving circuit. Also, it is possible to reduce the switching loss because the operation switch that forms the sustain-discharge circuit can perform the zero voltage switching by applying a ¼ resonance current waveform instead of a half resonance current.

According to the apparatus and method for driving the PDP, it is possible to prevent the rush current without an additional external protecting circuit just after the light emission starts.

In addition, it is possible to improve power efficiency by reducing switch conductance loss caused by circulating current shown in conventional sustain-discharge.

Also, it is possible to increase the slope of a sustain-discharge voltage waveform without changing the current stress of a supplementary switch by previously boosting the current of the inductor. Accordingly, it is possible to prevent the panel from being discharged without special reasons when the sustain-discharge voltage increases and decreases. It is also possible to prevent the generation of the rush current for charging the energy recovery capacitor when the sustain-discharge starts, so it is possible to improve the reliability and quality of products.

What is claimed is:

1. An apparatus for driving a plasma display panel including a plurality of address electrodes, a plurality of scan electrodes and sustain electrodes arranged in a zig-zag pattern so as to make pairs with each other, and a panel capacitor formed by the scan electrodes and the sustain electrodes, comprising:

a sustain-discharge unit comprising first and second switches that are serially connected to each other between a power source to which a sustain-discharge voltage is applied and a ground, and whose contact point is connected to a first end of the panel capacitor, and third and fourth switches that are serially connected to each other between the power source and the ground, and whose contact point is connected to a second end of the panel capacitor;

a first charge and discharge unit comprising a first inductor with a first end coupled to the first end of the panel capacitor, the first charge and discharge unit for increasing the voltage of the panel capacitor to the first sustain-discharge voltage using resonance of the first inductor and the panel capacitor; and a second charge and discharge unit comprising a second inductor with a first end coupled to the second end of the panel capacitor, the second charge and discharge unit for decreasing the voltage of the panel capacitor to the second sustain-discharge voltage using a resonance of the second inductor and the panel capacitor, wherein the sustain-discharge unit drives the first switch during the resonance of the first inductor to thus sustain the first sustain-discharge voltage, and drives the third switch during the resonance of the second inductor to thus sustain the second sustain-discharge voltage.

2. The apparatus of claim 1, wherein the first charge and discharge unit further comprises:

a fifth switch connected between the power source and a second end of the first inductor and operating so that the voltage of the panel capacitor increases to the first sustain-discharge voltage; and a first diode connected between the second end of the first inductor and the ground, the first diode for providing a path through which the current of the first inductor is recovered to the power source through a body diode of the first switch while the voltage of the panel capacitor is sustained to be at the first sustain-discharge voltage.

3. The apparatus of claim 2, wherein the first charge and discharge unit further comprises:

a second diode connected between the first end of the first inductor and the first end of the panel capacitor, the second diode for preventing the flow of current received from the panel capacitor; and a third diode connected between the second diode and the second switch, the third diode for forming a resonance path caused by the second inductor.

4. The apparatus of claim 1, wherein the second charge and discharge unit further comprises:

a fifth switch connected between the power source and a second end of the second inductor and operating so that voltage of the panel capacitor decreases to the second sustain-discharge voltage; and a first diode connected between the second end of the second inductor and the ground, the first diode for providing a path through which current of the second inductor is recovered to the power source through a body diode of the third switch while voltage of the panel capacitor is sustained to be at the second sustain-discharge voltage.

5. The apparatus of claim 4, further comprising:

a second diode connected between the first end of the second inductor and the second end of the panel capacitor, the second diode for preventing the flow of current received from the panel capacitor; and a third diode connected between the second diode and the fourth switch, the third diode for forming a resonance path caused by the first inductor.

6. The apparatus of claim 1, wherein the first charge and discharge unit further comprises:

fifth and sixth switches, that are serially connected to each other between the power source and the ground, and whose contact point is connected to a second end of the first inductor, which operate so that voltage of the panel capacitor increases to the first sustain-discharge voltage and decreases to the second sustain-discharge voltage;

a first diode connected between the ground and the second end of the first inductor, the first diode for providing a current path through which current of the first inductor is recovered to the power source through a body diode of the first switch while voltage of the panel capacitor is sustained to be at the first sustain-discharge voltage; and a second diode connected between the second end of the first inductor and the power source, the second diode for providing a current path through which current of the first inductor is recovered to the power source through a body diode of the second switch while the voltage of the panel capacitor is sustained to be at the second sustain-discharge voltage.

7. The apparatus of claim 6, wherein the first charge and discharge unit further comprises:

a third diode connected between the fifth switch and the second end of the first inductor, the third diode for providing a current flow path from the power source to the panel capacitor; and a fourth diode connected between the second end of the first inductor and the sixth switch, the fourth diode for providing a current flow path from the panel capacitor to the ground.

8. The apparatus of claim 1, wherein the second charge and discharge unit further comprises:

fifth and sixth switches that are serially connected to each other between the power source and the ground, and whose contact point is connected to a second end of the second inductor, which operate so that voltage of the panel capacitor decreases to the second sustain-discharge voltage and increases to the first sustain-discharge voltage;

a first diode connected between the ground and the second end of the second inductor, the first diode for providing a current path through which current of the second inductor is recovered to the power source through a body diode of the third switch while voltage of the panel capacitor is sustained to be at the second sustain-discharge voltage; and a second diode connected between the second end of the second inductor and the power source, the second diode for providing a current path through which current of the second inductor is recovered to the power source through a body diode of the fourth switch while voltage of the panel capacitor is sustained to be at the first sustain-discharge voltage.

9. The apparatus of claim 8, wherein the second charge and discharge unit further comprises:

a third diode connected between the fifth switch and the second end of the second inductor, the third diode for providing a current flow path from the power source to the panel capacitor; and a fourth diode connected between the second end of the second inductor and the sixth switch, the fourth diode for providing a current flow path from the panel capacitor to the ground.

10. An apparatus for driving a plasma display panel including a plurality of address electrodes, a plurality of scan electrodes and sustain electrodes arranged in a zig-zag pattern so as to make pairs with each other, and a panel capacitor formed by the scan electrodes and the sustain electrodes, comprising:

first and second switches that are serially connected to each other between a power source to which a sustain-discharge voltage is applied and a ground and whose contact point is connected to a first end of the panel capacitor;

third and fourth switches that are serially connected to each other between the power source and the ground, and whose contact point is connected to a second end of the panel capacitor;

a first inductor with a first end coupled to a first end of the panel capacitor, and a second inductor with a first end coupled to a second end of the panel capacitor;

fifth and sixth switches respectively connected between the power source and a second end of the first inductor and between the power source and a second end of the second inductor; and first and second diodes respectively connected between the second end of the first inductor and the ground and between the second end of the second inductor and the ground.

11. The apparatus of claim 10, further comprising:

third and fourth diodes respectively connected between the first end of the first inductor and the first end of the panel capacitor and between the first end of the second inductor and the second end of the panel capacitor in a forward direction; and fifth and sixth diodes respectively connected between the third diode and the second switch and between the fourth diode and the fourth switch in a forward direction.

12. An apparatus for driving a plasma display panel including a plurality of address electrodes, a plurality of scan electrodes and sustain electrodes arranged in a zig-zag pattern so as to make pairs with each other, and a panel capacitor formed by the scan electrodes and the sustain electrodes, comprising:

first and second switches that are serially connected to each other between a power source to which a sustain-discharge voltage is applied and a ground, and whose contact point is connected to a first end of the panel capacitor;

third and fourth switches, that are serially connected to each other between the power source and the ground, and whose contact point is connected to a second end of the panel capacitor;

a first inductor whose one end is coupled to one end of the panel capacitor, and a second inductor whose one end is coupled to the other end of the panel capacitor;

fifth and sixth switches that are serially connected to each other between the power source and the ground, and whose contact point is connected to a second end of the first inductor;

seventh and eighth switches that are serially coupled to each other between the power source and the ground, and whose contact point is connected to a second end of the second inductor;

first and second diodes that are serially connected to each other between the power source and the ground in a backward direction, and whose contact point is connected to the second end of the first inductor; and third and fourth diodes that are serially connected to each other between the power source and the ground in a backward direction, and whose contact point is connected to the second end of the second inductor.

13. The apparatus of claim 12, further comprising:

fifth and sixth diodes respectively connected between the fifth switch and the second end of the first inductor and between the second end of the first inductor and the sixth switch in a forward direction; and seventh and eighth diodes respectively connected between the seventh switch and the second end of the second inductor and between the second end of the second inductor and the eighth switch in a forward direction.

14. A method for driving a plasma display panel including a plurality of address electrodes, a plurality of scan electrodes and sustain electrodes arranged in a zig-zag pattern so as to make pairs with each other, a panel capacitor formed by the scan electrodes and the sustain electrodes, first and second switches that are serially connected to each other between a power source for supplying a sustain-discharge voltage and a ground and whose contact point is connected to a first end of the panel capacitor, third and fourth switches that are serially connected to each other between the power source and the ground and whose contact point is connected to a second end of the panel capacitor, and first and second inductors connected to the first end and the second end of the panel capacitor, the method comprising:

(a) increasing voltage of the panel capacitor to a first sustain-discharge voltage using a resonance generated by the panel capacitor and the first inductor due to the driving of the fourth switch and a fifth switch connected between the power source and the first inductor;

(b) driving the first and fourth switches during the resonance, to thus sustain voltage of the panel capacitor to be at the first sustain-discharge voltage;

(c) decreasing voltage of the panel capacitor to a second sustain-discharge voltage using a resonance generated by the panel capacitor and the second inductor due to the driving of the second switch and a sixth switch connected between the power source and the second inductor; and (d) driving the second and third switches during the resonance, to thus sustain voltage of the panel capacitor to be at the second sustain-discharge voltage.

15. The method of claim 14, wherein the step (b) further comprises the step of turning off the fifth switch to thus recover current of the first inductor to the power source through a diode connected between the first inductor and the ground, the first inductor, and a body diode of the first switch.

16. The method of claim 14, wherein the step (d) further comprises the step of turning off the sixth switch to thus recover current of the second inductor to the power source through a diode connected between the second inductor and the ground, the second inductor, and a body diode of the third switch.

17. A method for driving a plasma display panel including a plurality of address electrodes, a plurality of scan electrodes and sustain electrodes arranged in a zig-zag pattern so as to make pairs with each other, a panel capacitor formed by the scan electrodes and the sustain electrodes, first and second switches that are serially connected to each other between a power source for supplying a sustain-discharge voltage and a ground, and whose contact point is connected to a first end of the panel capacitor, third and fourth switches that are serially connected to each other between the power source and the ground, and whose contact point is connected to a second end of the panel capacitor, and first and second inductors connected to the first end and the second end of the panel capacitor, the method comprising:

(a) increasing voltage of the panel capacitor to a first sustain-discharge voltage using a resonance generated by the panel capacitor and the first and second inductors due to the driving of a fifth switch connected between the power source and the first inductor and a sixth switch connected between the second inductor and the ground;

(b) turning off the fifth and sixth switches during the resonance and driving the first and fourth switches to thus sustain voltage of the panel capacitor to be at the first sustain-discharge voltage;

(c) decreasing voltage of the panel capacitor to a second sustain-discharge voltage using a resonance generated by the panel capacitor and the first and second inductors due to the driving of a seventh switch connected between the power and the second inductor and an eighth switch connected between the first inductor and the ground; and (d) turning off the seventh and eighth switches during the resonance and driving the second and third switches to thus sustain voltage of the panel capacitor to be at the second sustain-discharge voltage.

18. The method of claim 17, wherein the step (b) further comprises the step of recovering current of the first inductor to the power source through a first diode connected between the ground and the first inductor, the first inductor, and a body diode of the first switch, and recovering current of the second inductor through the body diode of the fourth switch, the second inductor, and a second diode connected between the second inductor and the power source.

19. The method of claim 17, wherein the step (d) further comprises the step of recovering current of the first inductor through a body diode of the second switch, the first inductor, and a first diode connected between the first inductor and the power source and recovering the second inductor through a second diode connected between the ground and the second inductor, the second inductor, and a body diode of the third switch.

20. A method for driving a plasma display panel including a plurality of address electrodes, a plurality of scan electrodes and sustain electrodes arranged in a zig-zag pattern so as to make pairs with each other, a panel capacitor formed by the scan electrodes and the sustain electrodes, first and second switches that are serially connected to each other between a power source for supplying a sustain-discharge voltage and a ground and whose contact point is connected to a first end of the panel capacitor, third and fourth switches that are serially connected to each other between the power source and the ground and whose contact point is connected to a second end of the panel capacitor, and first and second inductors connected to the first end and the second end of the panel capacitor, the method comprising:

(a) driving the first and fourth switches to thus sustain voltage of the panel capacitor to be at a first sustain-discharge voltage;

(b) additionally driving fifth and sixth switches respectively connected between the ground and the first inductor and between the second inductor and the power source to thus inject current into the first and second inductors in a state where voltage of the panel capacitor is sustained to be at the first sustain-discharge voltage;

(c) turning off the first, fourth, fifth, and sixth switches to thus decrease voltage of the panel capacitor to a second sustain-discharge voltage using a resonance generated by the first and second inductors and the panel capacitor;

(d) driving the second and third switches to thus sustain voltage of the panel capacitor to be at the second sustain-discharge voltage;

(e) additionally driving seventh and eighth switches respectively connected between the power source and the first inductor and between the second inductor and the ground to thus inject current into the first and second inductors in a state where voltage of the panel capacitor is sustained to be at the second sustain-discharge voltage; and (f) turning off the second, third, seventh, and eighth switches to thus increase voltage of the panel capacitor to a first sustain-discharge voltage using a resonance generated by the first and second inductors and the panel capacitor.

21. A method for driving a plasma display panel including a plurality of address electrodes, a plurality of scan electrodes and sustain electrodes arranged in a zig-zag pattern so as to make pairs with each other, a panel capacitor formed by the scan electrodes and the sustain electrodes, first and second switches that are serially connected to each other between a power source for supplying a sustain-discharge voltage and a ground and whose contact point is connected to a first end of the panel capacitor, third and fourth switches that are serially connected to each other between the power source and the ground and whose contact point is connected to a second end of the panel capacitor, and first and second inductors connected to the first end and the second end of the panel capacitor, the method comprising:

(a) driving fifth and sixth switches respectively connected between the power source and the first inductor and between the second inductor and the ground to thus inject current into the first and second inductors in a state where voltage of the panel capacitor is sustained to be at a first sustain-discharge voltage by the driven second and third switches;

(b) turning off the second and third switches to thus increase voltage of the panel capacitor to a second sustain-discharge voltage using a resonance generated by the first and second inductors and the panel capacitor;

(c) turning off the fifth and sixth switches and driving the first and fourth switches to thus sustain voltage of the panel capacitor to be at the second sustain-discharge voltage;

(d) additionally driving seventh and eighth switches respectively connected between the first inductor and the ground and between the power source and the second inductor to thus inject current into the first and second inductors in a state where voltage of the panel capacitor is sustained to be at the second sustain-discharge voltage;

(e) turning off the first and fourth switches to thus decrease the panel capacitor to the first sustain-discharge voltage using a resonance generated by the first and second inductors and the panel capacitor; and (f) turning off the seventh and eighth switches and driving the second and third switches to thus sustain voltage of the panel capacitor to be at the first sustain-discharge voltage.

22. The method of claim 21, wherein the step (c) further comprises the step of recovering current of the first inductor to the power source through a first diode connected between the ground and the first inductor, the first inductor, and a body diode of the first switch, and recovering current of the second inductor through a body diode of the fourth switch, the second inductor, and a second diode connected between the second inductor and the power source.

23. The method of claim 21, wherein the step (f) further comprises the step of recovering current of the first inductor to the power source through a body diode of the second switch, the first inductor, and a first diode connected between the power source and the first inductor, and recovering current of the second inductor to the power source through a second diode connected between the ground and the second inductor, the second inductor, and a body diode of the third switch.

* * * * *